United States Patent [19]

Aiuola et al.

[11] 4,261,159

[45] Apr. 14, 1981

[54] APPARATUS FOR TRANSPORTING AND INSERTING BAGS INTO BOXES

[76] Inventors: Franco Aiuola, Via Ranzani, 17-Bologna; Bruno Drusiani, Via Guinizzelli, 12, Casalecchio di Reno, Bologna, both of Italy

[21] Appl. No.: 26,634

[22] Filed: Apr. 3, 1979

[30] Foreign Application Priority Data

Jun. 6, 1978 [IT] Italy ..... 41593 A/78

[51] Int. Cl.[3] ..... B65B 5/04; B65B 39/12

[52] U.S. Cl. ..... 53/258; 53/259

[58] Field of Search ..... 53/258, 248, 249, 251, 53/252, 259, 540

[56] References Cited

U.S. PATENT DOCUMENTS

| | | | |
|---|---|---|---|
| 2,949,000 | 8/1960 | Johnson et al. | 53/248 X |
| 3,052,075 | 9/1962 | Velasquez | 53/259 |
| 3,088,257 | 5/1963 | Penley | 53/258 X |
| 3,470,674 | 10/1969 | Madonia | 53/540 X |
| 4,047,362 | 9/1977 | Lister et al. | 53/258 X |
| 4,104,847 | 8/1978 | Glandon et al. | 53/259 X |

*Primary Examiner*—Horace M. Culver

*Attorney, Agent, or Firm*—Guido Modiano; Albert Josif

[57] ABSTRACT

An apparatus for transporting bags from a first station to a second station and for inserting the bags into boxes at the second station comprises a reciprocating frame, a first conveyor belt movable towards the second station, a gripper for picking up a bag at the first station and releasing it to lie on the first conveyor belt, and a second conveyor belt underlying the first conveyor belt and receiving the bag released by the first conveyor belt to carry it to the second station. A pusher assists and completes the action of the second conveyor belt in inserting the bag deposited thereon into one of the boxes positioned at the second station.

6 Claims, 5 Drawing Figures

52
48
49
53
50
56
55
47
57
1
54
50
17
G2
47
12
G1
51
D2
D1
A
16
15
11
14
40
46
44 c
13
5
4
37
38
18
45
44
9
39
c1
6
c2
28
19
44b
7
E
51
21
20
27
62a
30
29
27a
58
31a
62b
10a
23
24
59
10b
29
8
22
44a
25
31
43
42
10c
F
62
31b
33
26
24a
32
10d
10
36
36
60
41
34
35
61

APPARATUS FOR TRANSPORTING AND INSERTING BAGS INTO BOXES

BACKGROUND OF THE INVENTION

This invention relates to an apparatus for transporting and inserting bags into boxes.

The bags, which are formed, filled and sealed by means of suitable automatic packaging machines, usually reach the machine delivery station intermittently, and are presented to said station in an upright attitude.

Occasionally, the bags delivered by the machine that manufactured them, are then to be inserted into respective boxes which are supplied intermittently to a filling station, whereat the box mouth presents itself substantially parallel to the plane of the bag leaving the cited machine and facing that same plane. It does happen that the distance separating said box mouth from said bag plane is such that, while it is sufficiently large as not to allow the bags to be inserted into the boxes in a direct manner, it is also small enough to require a highly accurate handling of the bags.

SUMMARY OF THE INVENTION

Thus, the technical problem that the instant apparatus sets out to solve is to provide for the transport and insertion of bags into boxes, even in the special conditions just described.

Within that general aim, it is an object of the instant apparatus to subject the bags to much reduced mechanical stresses, and in all cases such as to eliminate the risk of damaging and breaking the bags, even when the latter are caused to undergo folding or deforming treatments for the purpose of inserting them into the boxes.

A further object of the apparatus is the provision of a simple structure, especially as relates to the controls therefor, while retaining a high production rate of the bag making machine.

These and other objects, such as will be apparent hereinafter, are achieved by an apparatus for transporting bags from a first station, whereto said bags are intermittently delivered arranged in a vertical plane, to a second station, whereto respective boxes having a mouth facing said plane are delivered intermittently, and for inserting said bags into respective ones of said boxes, characterized in that it comprises a frame caused to reciprocate between first and second positions, respectively proximate said first and second stations, a first conveyor carried by said frame, a gripper carried by an arm caused to swing between said first station and said first position and respectively intended for picking up a bag at said first station and releasing it to lie on said first conveyor when said frame is at said first position, drive means for said first conveyor operative to impart thereto a movement in the direction towards said second position while said frame is moving in the opposite direction towards said first position, such as to correspondingly cause said bag to be released by said first conveyor, a second conveyor underlying said first conveyor and extending to said second station and receiving the bag thus released by said first conveyor, drive means for said second conveyor operative to move it towards said second station while said frame is moving towards its related second position, a pusher arranged to shave said second conveyor and reciprocated in combination with said frame, thereby as said frame is travelling towards said second position, said pusher assists and completes the action of said second conveyor in inserting a bag deposited thereon into one of said boxes positioned at said second station.

BRIEF DESCRIPTION OF THE DRAWINGS

Further details will become more clearly apparent from the following description of a preferred embodiment of this apparatus for transporting and inserting bags into boxes, when taken along with the accompanying drawings, where.

DESCRIPTION OF A PREFERRED EMBODIMENT

Figure 1:
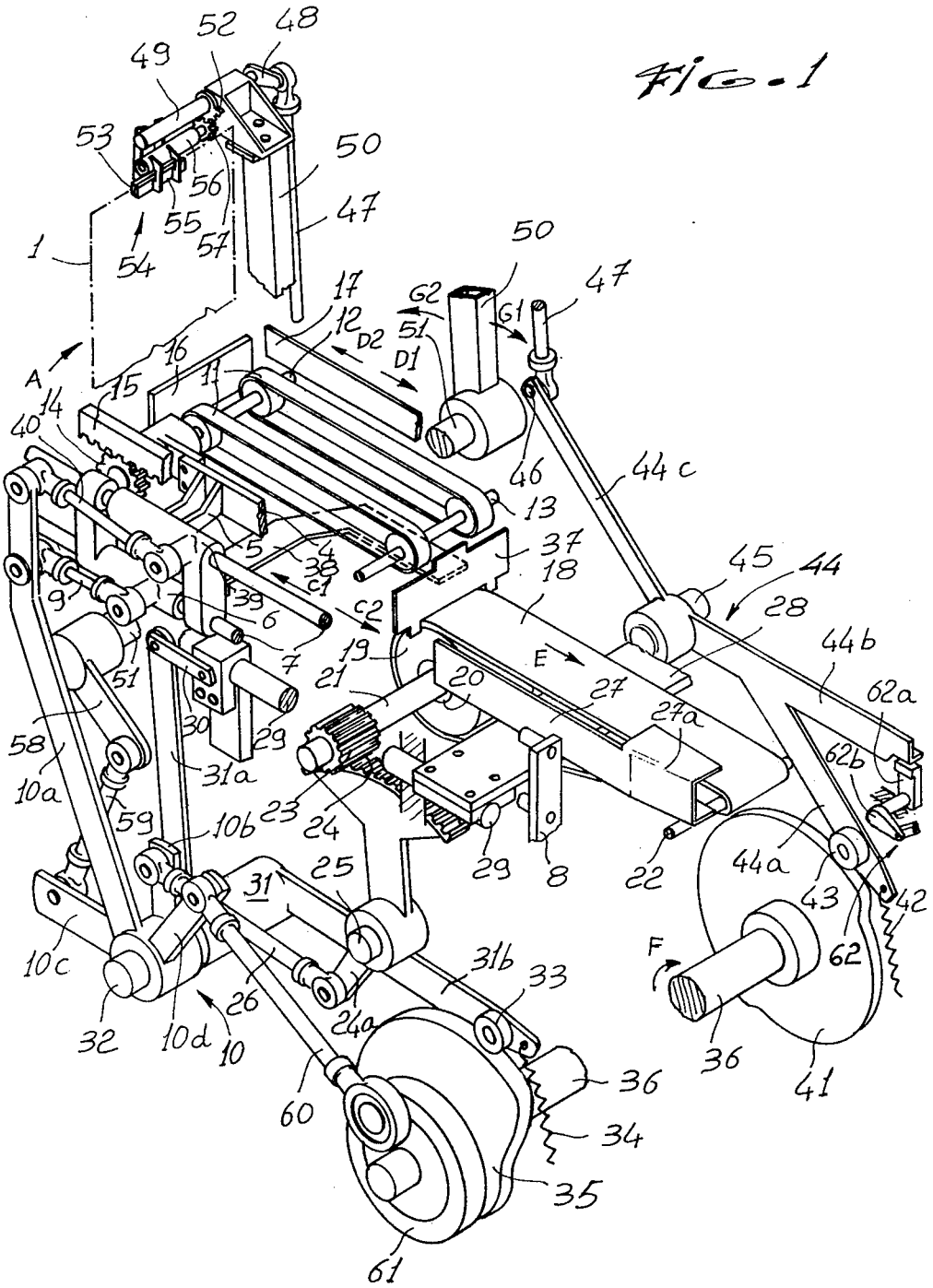
FIG. 1 is a schematical perspective, partly fragmentary view of the instant apparatus; and FIGS. *2a, 2b, 2c* and *2d* are schematical, longitudinal elevation views showing sequential steps of the apparatus operation.
Figure 2A:
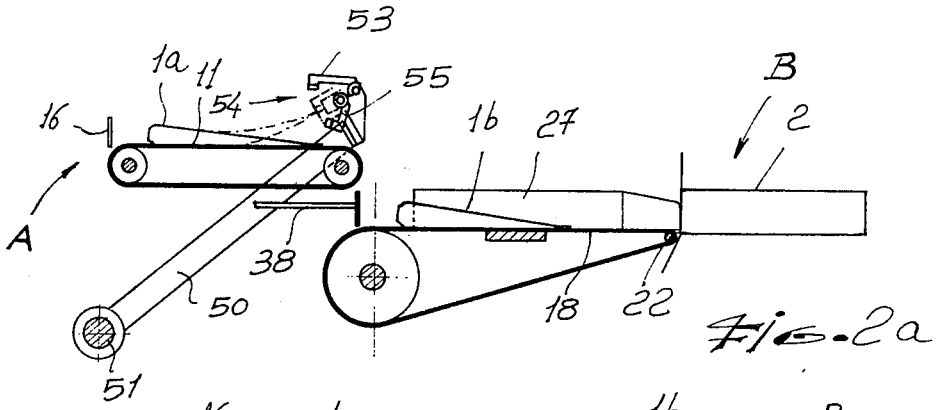
Figure 2B:
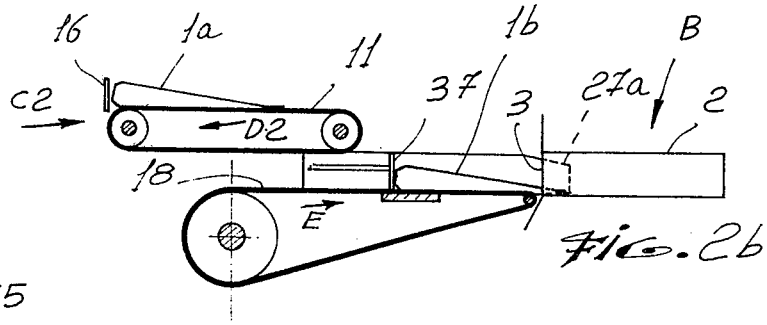
Figure 2C:
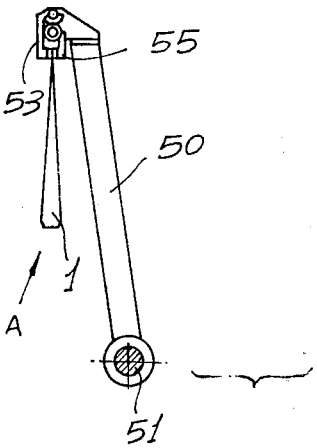
Figure 2C:
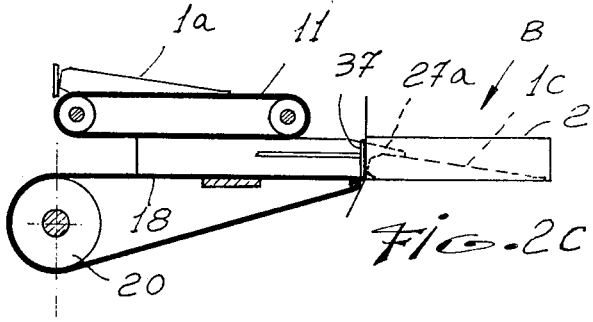
Figure 2D:
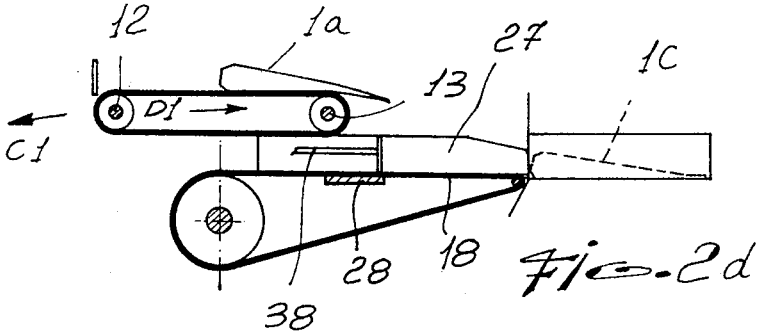

In the drawing figures, the reference numeral 1 denotes a bag which is positioned in an upright position at a first station A, and specifically at the delivery station of a bag making machine, which machine effectively forms, fills and seals the bags. To said first station the bags are delivered intermittently, one by one. The numeral 2 (FIGS. *2a, 2b, 2c, 2d*) denotes instead a box lying horizontally at a second station B, whereto the boxes are delivered, one at a time and intermittently. At said second station, the mouth 3 of the box 2 is in the open condition, facing the vertical plane of the bag 1 and substantially parallel to this plane.

At a higher level than that of the box 2, between first and second positions respectively proximate to the station A and station B, a horizontal frame is carried slidably which is exemplified herein by the flat element 4, such that whenever this frame will be referred to hereinafter, it will be denoted with the numeral 4. The element 4 is mounted, by means of brackets 5, rigidly to a first portion 6 of a double sleeve which is guided slidably along a pair of small rods 7; the small rods 7, similarly to the flat element 4, are horizontal and perpendicular to the plane containing the bag 1, and from approximately this plane, extend towards the station B; the small rods 7 are stationary and have their ends supported by lugs 8 of the apparatus structure, which structure will be referred to by the numeral 8. To the double sleeve 6, there is articulated a first connecting rod 9 which is also articulated, at its other end, to a first arm 10*a* of a rocker arm 10, also comprising a second, third and fourth arms, respectively 10*b*, 10*c*, 10*d*, which will be described hereinafter. Under control by the rocker arm 10, the double sleeve, and accordingly the frame 4 thus perform a reciprocating sliding movement, as indicated by the double arrowhead C1, C2. The frame 4 carries a first conveyor 11 comprising a pair of belts of closed loop configuration; the pulleys for the belts 11 are keyed to respective shafts, a front shaft 12 and a rear shaft 13, which are pivotally mounted to the frame 4 and extend parallel to the vertical plane of the bab 1, lying in a common horizontal plane perpendicular to the cited vertical plane. To the rear shaft 12, which is the driving axle of the belts 11 and which is closer to the station A than the shaft 13, is also keyed a first pinion gear 14, which is in constant mesh with a rack 15 extending parallel to the small rods 7 and being attached to the structure 8. During the strokes C1, C2 of the frame 4, the top runs of the belts 11, owing to 14 and 15 meshing together, move in the directions D1 and D2, the instantaneous speeds of the belts being equal and opposite to those of the frame 4. In the proximity of the shaft 12, the frame 4 has a detent or stop 16; that same frame carries first side shields 17 alongside the belts 11: in FIG. 1, for clarity reasons, one only of said side shields is shown, and its connections to the frame 4 have been omitted from view.

At a lower level than that of the first belt conveyor 11, there is provided a second belt conveyor 18, of closed loop configuration and extending to said station B. The belt 18 is passed at the rear around a large pulley 19 which, with the interposition of a suitable clutch ratchet mechanism 20, is mounted to a first shaft 21, pivotally carried in the structure 8 of the machine. At the front, the belt 18 is passed around a roller 22 which has reduced diameter and is also carried pivotally in the structure 8. The first shaft 21 and roller 22 are parallel to the rear and front shafts 12 and 13. The top, horizontal run of the belt 18 is virtually coplanar with the bottom wall of the box 2. To the first shaft 21, there is keyed a gear wheel 23, which is in mesh engagement with a gear segment or toothed sector 24; this gear segment is mounted for oscillation to the structure 8 through a first pivot pin 25. To the lug 24*a* of said gear segment 24, there is articulated a second connecting rod 26, which is also articulated to a second arm 10*b* of the rocker arm 10. Being driven or controlled by the rocker arm 10, the gear segment 24, through the gear wheel 23, causes rotation, in either directions, of the shaft 21 constituting the drive rod of the belt 18: however, it should be noted that, owing to the presence of the ratchet mechanism 20, there is but one direction of rotation wherein the shaft 21 is allowed to drive the pulley 19, and accordingly the belt 18; specifically, the top run of the belt 18 is driven in the direction indicated by the arrow E, concurrent with C2 and D1, i.e. towards the station B. Alongside the belt 18, there are provided second side shields 27. In FIG. 1, for clarity of illustration, only one such second side shield is shown. The second side shields 27 terminate at the station B converging to each other; correspondingly, they define respective portions 27*a* which form together a member of general hopper-like configuration, adapted for penetrating the mouth 3 of the box 2. The two second side sheilds 27 are joined together by a cross-member 28, which is rigid with a rod 29 extending parallel to the rods 7 and guided for sliding in the structure 8. To the rod 29 there is articulated a third connecting rod 30 which is also articulated to a first lever arm 31*a* of a first lever 31 which is further provided with a second lever arm 31*b*; the first lever 31 is mounted for oscillation to a second pivot pin 32, carried in the structure 8, whereto the rocker arm 10 is also mounted for oscillation. A small roller 33 on the second lever arm 31*b* engages, under the action of a first spring 34, with the profiled edge of a first cam 35, keyed to a second shaft 36. The second shaft 36, which is carried pivotally in the structure 8, is driven by continuous rotary motion in the direction P and the duration of a complete revolution thereof is equal to the time elapsing between two successive arrivals of a bag 1 at the station A and of a box 2 at the station B. Under control by the cam 35, the first lever 31 produces reciprocating strokes of the pair of second side shields 27, as will be explained more clearly hereinafter with reference to FIGS. 2*a* to 2*d*. Underlying the belts 11, there is provided a pusher 37, intended for shaving the top run of the belt 18. To the rear face of the pusher 37, there is mounted a support 38 rigidly therewith, which is also rigid with the second portion 39 of said double sleeve, arranged to slide along the small rods 7. Between the first arm 10*a* of the rocker arm 10 and the second portion 39 of the double sleeve, there is interposed a fourth connecting rod 40; it thus happens that, in combination with the strokes C1 and C2 of the frame 4, similar reciprocating strokes are performed by the pusher 37, as will be explained hereinafter. Furthermore, a second cam 41 is keyed to the second shaft 36, with the profiled edge whereof there is engageable, under the action of a second spring 42, a second smaller roller 43 of a brace 44*a* on a second lever 44 also carrying a fifth and sixth arm 44*b* and 44*c*. Through a third pivot pin 45, the lever 44 is mounted for oscillation on the structure 8. To the sixth arm 44*c*, through a fourth pin 46, there is articulated one end of a fifth connecting rod 47, the other end whereof is articulated to a second rocker arm 48. The second rocker arm 48 is keyed to one end of a small shaft 49, which is carried for oscillation on the top end of a seventh arm 50 having its bottom end keyed to a third shaft 51. The third shaft 51 is swingingly carried by the structure 8, and like the second shaft 36 and small shaft 49, extends parallel to the rear and front shafts 12 and 13. Now, to the small shaft 49, there is keyed a second gear segment or toothed sector 52, and a rigidly mounted first claw 53 of a gripper 54. The second claw 55 is rigid with a second small shaft 56, which is carried for oscillation by the top end of the seventh arm 50 in parallel relationship with the small shaft 49. To the second small shaft 56, moreover, there is also keyed a second pinion gear 57 in mesh engagement with the second gear segment 52. Radially arranged with respect to the third shaft 51, there is further provided an eighth arm 58, which through a sixth connecting rod 59, is connected to the third arm 10*c* of the rocker arm 10. The fourth arm 10*d* of that same rocker arm is connected, through a seventh connecting rod 60, to a disc type of crank 61, keyed to the second shaft 36. Being driven or controlled by the rocker arm 10, the seventh arm 50 of the gripper 54 thus performs oscillations G1, G2, on completion whereof the gripper is located respectively above the belts 11 and at the station A. At the station A, the gripper 54 is opened, and is then closed to grip the top of the bag 1 just delivered to said station; the closing command is imparted to the claws 53 and 55 by the second cam 41 through the second lever 44, fifth connecting rod 47, second rocker arm 48, second gear segment 52, and second pinion gear 57. Upon the issueing of the command to close, the fourth pivot pin 46 is located coaxial with the third shaft 51, this coaxial relationship being retained, by virtue of the second cam 41, throughout the stroke G1, i.e. until the gripper 54 is located on the belts 11 and is thus enabled to release a bag, which is then laid thereon; the bag positioned on the belts 11 is indicated at 1*a*. Upon release of the bag, the second cam 41 causes the fourth pin 46 to become offset with respect to the third shaft 51, the pin remaining thus offset throughout the stroke G2, thereby the gripper 54 remains open. Upon opening of the gripper 54, under the fifth arm 44*b* a first jut 62*a* of a third rocker arm 62 can be positioned, said rocker arm being further provided with a second jut 62*b* which is carried for oscillation in the structure 8; the second jut 62*b* is articulated to the keeper of a solenoid, not shown. Such a solenoid, carried in the structure 8, is in fact intended for actuation as a bag is about to reach the station A which, for any reason or anomaly whatever, is not to be picked up and inserted into a box 2; upon energization of the solenoid, the first jut 62*a* moves to a position under the fifth arm 44b and supports it as the fourth arm 44a would tend to drop in order to maintain the second small roller 43 in engagement with the portion of the second cam 41 as well, which is operative to close the gripper 54. Thus, as the gripper 54 reaches the station A, it cannot close and grip the anomalous bag, which is therefore removed from the station A in some other way; in this particular case, the stroke G1 being in progress, the gripper 54 remains open and releases no bag onto the belts 11; during the following stroke G2, if said solenoid is de-energized because the freshly arriving bag at A has no anomalies, the first jut 62a is returned to its rest position and the gripper 54 at A is closed to pick up that fresh bag. It should be noted that in FIG. 1, for clarity of illustration, the right-hand portions of the third shaft 51 and second shaft 36 (shown cut away) are artfully shifted to the right along their axes; consequently, the second lever 44, second cam 41 and lower portions of the seventh arm 50 of the fifth connecting rod 47 (the arm and conrod being shown cut away) are also shifted to the right. However, it should be further noted that the upper portions of the seventh arm 50 and fifth connecting rod 47 have not been shifted intentionally as mentioned; the arm and connecting rod are, however, positioned at the angular position which corresponds to the travel limit of the stroke G2, i.e. in an imperfect phase relationship with the other components of the apparatus. The various phase relationships have instead been observed in FIGS. 2a to 2d, with reference whereto the description of the apparatus operation principle will be completed herein below.

As the frame reaches the limit of the stroke C1 (FIG. 2a), the gripper 54, owing to the seventh arm 50 reaching the end or limit of the stroke G1, opens and releases the bag 1a laid on the belts 11; in the meantime, on the belt 18, a bag 1b has already been positioned and a box 2 is about to reach the station B. Thus, while the seventh arm 50, with the stroke G2, is raised back to the station A, the frame 4 and pusher 37 (FIG. 2b) just start along their strokes C2. During such strokes, the belts 11 are driven in the direction D2 and cause the bag 1a to abut against the detent 16, being then maintained so abutted; the belt 18 travels in the direction E and, with the added assistance of the pusher 37, having approximately the same instantaneous speed, entrains the bag 1b causing it to enter the box 2 located at B. As the bag 1b moves forwards, it may be subjected to a folding treatment of the edges extending parallel to the second side shields 27, owing to the converging termination thereof; the hopper portions 27a of the second side shields 27, under control by the cam 35, penetrate the mouth 3 of the box 2, thus ensuring the introduction of the bag into the box and its correct adaptation thereto, even though it is slightly forced to enter said box. At the end or limit of the stroke C2, the pusher 37 overtakes the belts 11 (FIG. 2c) and, upon reaching the level of the mouth 3, completes the insertion of the bag into the box: the bag, as fully inserted or introduced into the box, is indicated at 1c. At this point, the bag 1a has reached a position overlying the belt 18, from which position, as will be described hereinafter, it will be released to drop, substantially by gravity alone, onto the belt 18. In this position, which the bag 1a, as will be explained, retains for some time, another element may be deposited on the bag which is intended for insertion into a box 2 along with it: this element, which will be preferably flat, can be, for example, a small bag containing a complementary product to the product contained in the main bag 1. Thus, among others, the apparatus affords this added advantage. As the insertion of a bag into the box 2 is being carried out, the seventh arm 50 has reached A, and between the claws 53 and 55, being opened in the gripper 54, is positioned a bag 1, which upon closing the gripper is picked up thereby. As the strokes C1 (FIG. 2d) are initiated of the frame 4 and pusher 37, the hopper portions 27a are withdrawn from the box 2, which being thus filled is then removed from the station B to make room for a fresh box to be filled; at the same time, the seventh arm 50 is about to drop from the station A towards the plane of the belts 18. During the strokes C1, the belts 11 travel in the direction D1, thereby the bag 1a remains at the same position which it had reached at the end of the stroke C2 of the frame 41; the support offered to the bag 1a by the belts 11 being then progressively removed, the bag drops onto the belt 18, which is now stationary, the pusher 37 being already positioned underneath the belts 11: in this manner, the bags are released onto the belt 18, at all times at a well defined position.

The apparatus, as described, achieves its objects as specified in the foregoing. In particular, it should be noted that it is capable of transporting the bags accurately and at a fairly high rate from one station to another which are some distance apart. It should be further noted that the bags, which are practically handled by members performing very limited sliding movements with respect thereto, are no longer likely to suffer damage or breakage. Finally, it is stressed that the major part of the apparatus controls comprises but the rocker arm 10 with its multiple arms, which further enhances the simple construction of this apparatus.

We claim:

1. An apparatus for transporting bags from a first station, whereto said bags are intermittently delivered arranged in a vertical plane, to a second station, whereto respective boxes having a mouth facing said plane are delivered intermittently and for inserting said bags into respective ones of said boxes, said apparatus comprising a frame reciprocable between a first and a second position, respectively proximate to said first and second stations, a first conveyor carried by said frame, a gripper carried by an arm swingable between said first station and said first position and respectively intended for picking up a bag at said first station and releasing it to lie on said first conveyor when said frame is at said first position, drive means for said first conveyor operative to impart thereto a movement in the direction towards said second position while moving said frame in the opposite direction towards said first position, such as to correspondingly cause said bag to be released by said first conveyor, a second conveyor underlying said first conveyor and extending to said second station and receiving the bag thus released by said first conveyor, drive means for said second conveyor operative to move it towards said second station while said frame is moving towards its related second position, a pusher arranged to move over said second conveyor and to reciprocate in combination with said frame, whereby as said frame is travelling towards said second position, said pusher assists and completes the action of said second conveyor in inserting a bag deposited thereon into one of said boxes positioned at said second station.

2. An apparatus according to claim 1, wherein said drive means for said first conveyor also imparts a movement towards said first position while said frame performs its stroke movement in the opposite direction towards said second position, and correspondingly cause the bag, laid on said first conveyor, to abut against a detent presented by said frame.

3. An apparatus according to claim 1, wherein said drive means for said first conveyor comprises a rack arranged along the path of said frame and a first pinion gear keyed to a rear shaft of said first conveyor and mashing with said rack.

4. An apparatus according to claim 1, including two side shields or second side shields located alongside said second conveyor which terminate towards said second station convergent thereto with a hopper portion and which are jointly reciprocable such that, correspondingly to the action of said second conveyor and said pusher of inserting a bag into the box positioned at said second station, said hopper portion penetrates the mouth of said box.

5. An apparatus according to claim 1, wherein said pusher, as said frame completes its stroke to said second position, is driven by said first conveyor drive means to complete its relative stroke by overtaking said first conveyor and reaching to level of the mouth of the box positioned at said second station, whereas as said frame completes its stroke in the opposite direction, said pusher completes its relative stroke immediately below said first conveyor.

6. An apparatus according to claim 1, including a single rocker arm having multiple arms driven by a crank system through connecting rods articulated to said arms, said rocker arm determining the reciprocating strokes of said frame and said pusher, the oscillations of said arm of said gripper and the oscillations of a gear segment arranged to mesh with a gear wheel, said gear wheel being mounted, with the interposition of a clutch ratchet mechanism, to said first shaft of said second conveyor.

* * * * *